US005287802A

United States Patent [19]

Pearson

[11] Patent Number: 5,287,802

[45] Date of Patent: Feb. 22, 1994

[54] STRAP SEVERING AND EJECTING MECHANISM FOR STRAPPING MACHINE

[75] Inventor: Timothy B. Pearson, Anitoch, Ill.

[73] Assignee: Signode Corporation, Glenview, Ill.

[21] Appl. No.: 990,097

[22] Filed: Dec. 14, 1992

[51] Int. Cl.[5] ..... B65B 57/10; B65B 13/06

[52] U.S. Cl. ..... 100/4; 53/589; 83/61; 83/950; 100/26; 100/32

[58] Field of Search ..... 100/4, 26, 29, 32; 53/589; 226/25; 83/61, 950

[56] References Cited

U.S. PATENT DOCUMENTS

| | | | |
|---|---|---|---|
| 2,915,003 | 12/1959 | Crosby et al. | 100/26 |
| 3,207,018 | 9/1965 | Rauenbuehler et al. | 226/25 X |
| 4,041,814 | 8/1977 | High | 83/950 X |
| 4,137,788 | 2/1979 | Fischer | 53/589 X |
| 4,145,963 | 3/1979 | Leslie et al. | 100/4 |
| 4,351,463 | 9/1982 | Knecht | 226/154 |
| 4,569,186 | 2/1986 | Mori et al. | 53/589 |
| 4,691,498 | 9/1987 | Stamm | 53/399 |
| 4,724,659 | 2/1988 | Mori et al. | 53/589 |

FOREIGN PATENT DOCUMENTS

| | | | |
|---|---|---|---|
| 118037 | 3/1978 | Fed. Rep. of Germany . | |
| 2837164 | 3/1980 | Fed. Rep. of Germany . | |
| 3019929 | 12/1981 | Fed. Rep. of Germany . | |
| 3825668 | 2/1990 | Fed. Rep. of Germany . | |
| 1-213107 | 8/1989 | Japan | 100/26 |

*Primary Examiner*—Stephen F. Gerrity

*Attorney, Agent, or Firm*—T. W. Buckman; D. J. Breh; J. P. O'Brien

[57] ABSTRACT

In a straps machine comprising strap-advancing rollers, a sensor for sensing whether a leading end of an advancing strap has reached a predetermined location within a predetermined time, and strap-retracting rollers, a severing and ejecting mechanism comprises a die and an anvil for severing the strap into a leading portion including the leading end and a trailing portion if the sensor has not sensed that the leading end has reached the predetermined location within the predetermined time. The mechanism also comprises a drivable roller, a motor for driving it, and two idle rollers on a pivotable yoke. The drivable roller and one of the idle rollers are operative for ejecting the leading portion after the strap has been severed. The drivable roller and the other idle roller are operative for feeding the trailing portion through the mechanism after the leading portion has been ejected.

8 Claims, 3 Drawing Sheets

PROGRAMABLE CONTROLLER
STRAP DISPENSER

STRAP SEVERING AND EJECTING MECHANISM FOR STRAPPING MACHINE

TECHNICAL FIELD OF THE INVENTION

This invention pertains to a mechanism for severing a strap being fed into a strapping head of a strapping machine if a sensor fails to sense that a leading end of the strap has been advanced to a predetermined location within a predetermined time, as when the strap has become jammed, and for ejecting a leading portion of the severed strap. The mechanism permits a trailing portion of the severed strap to be then fed into the strapping head.

BACKGROUND OF THE INVENTION

Generally, a strapping machine of a type in widespread use is used for applying a plastic strap in a tensioned loop around a load. Typically, the strapping machine comprises a strap chute for guiding the strap around the load and a strapping head, into which a leading end of the strap is fed. Commonly, the strapping machine is utilized with a strap dispenser, which is arranged to dispense indeterminate lengths of the strap from a coil of strapping. It is known to utilize two strap dispensers, which can be alternately operated, with such a strapping machine.

Generally, the strapping head includes means for advancing the strap along the strap chute, around the load, until the leading end returns to the strapping head, and means for retracting the strap so as to pull the strap from the strap chute and to produce a tension in the strap around the load. Generally, moreover, the strapping head includes means for securing the strap in a tensioned loop around the load either by welding the strap to itself at its overlapping portions or by applying a metal seal to the overlapping portions via the strapping head and means for severing the strap in the tensioned loop from the remaining strap.

Furthermore, it is typical for the strapping head to comprise means for sensing whether the leading end of the strap being advanced has reached a predetermined location relative to the strapping head, within a predetermined time during an operating cycle of the strapping machine. Generally, if the strap becomes jammed within the strap chute or exits the strap chute before reaching the sensor, the leading end of the strap is not sensed as having reached the predetermined location within the predetermined time.

It is known to arrange the strapping head so that, if the leading end of the strap is not sensed as having reached the predetermined location within the predetermined time, the strap is retracted by the retracting means of the strapping head. It is known for a user manually to sever any deformed portion of the retracted strap from the remaining strap. It is known for the leading end of the remaining strap from the same dispenser or the leading end of a different strap from a different dispenser to be manually or automatedly fed into the strapping head for a following cycle.

SUMMARY OF THE INVENTION

This invention provides a mechanism for use with a strapping machine comprising a strapping head, means for advancing a strap fed into the strapping head, means for sensing whether a leading end of the strap being advanced has reached a predetermined location within a predetermined time, and means for retracting the strap. Such means may be known means discussed above. The mechanism comprises means for severing the strap being fed into the strapping head into a leading portion including the leading end and a trailing portion if the sensing means has not sensed that the leading end has reached the predetermined location within the predetermined time and means adapted to coact with the retracting means for ejecting the leading portion after the strap has been severed.

Preferably, the mechanism further comprises means for feeding the trailing portion into the strapping machine after the leading portion has been ejected. The ejecting means and the feeding means may comprise a common, drivable roller and separate, idle rollers. The mechanism may further comprise means for moving the idle roller of the ejecting means toward the drivable roller when the leading portion is to be thus ejected and for moving the idle roller of the feeding means toward the drivable roller when the trailing portion is to be thus advanced. The mechanism may further comprise a motor arranged to drive the drivable roller when the leading portion is to be thus ejected and when the trailing portion is to be thus advanced.

The moving means may comprise a pivotable yoke, to which the idle rollers are mounted rotatably and in spaced relation, and a solenoid arranged to pivot the pivotable yoke. Preferably, the solenoid is arranged to pivot the pivotable yoke from a normal position selectively to a position wherein the idle roller of the ejecting means is moved toward the drivable roller and a position wherein the idle roller of the feeding means is moved toward the drivable roller. Preferably, moreover, the pivotable yoke is biased toward the normal position.

These and other objects, features, and advantages of this invention are evident from the following description of a preferred embodiment of this invention with reference to the accompanying drawings.

DETAILED DESCRIPTION OF PREFERRED EMBODIMENT

Figure 1:
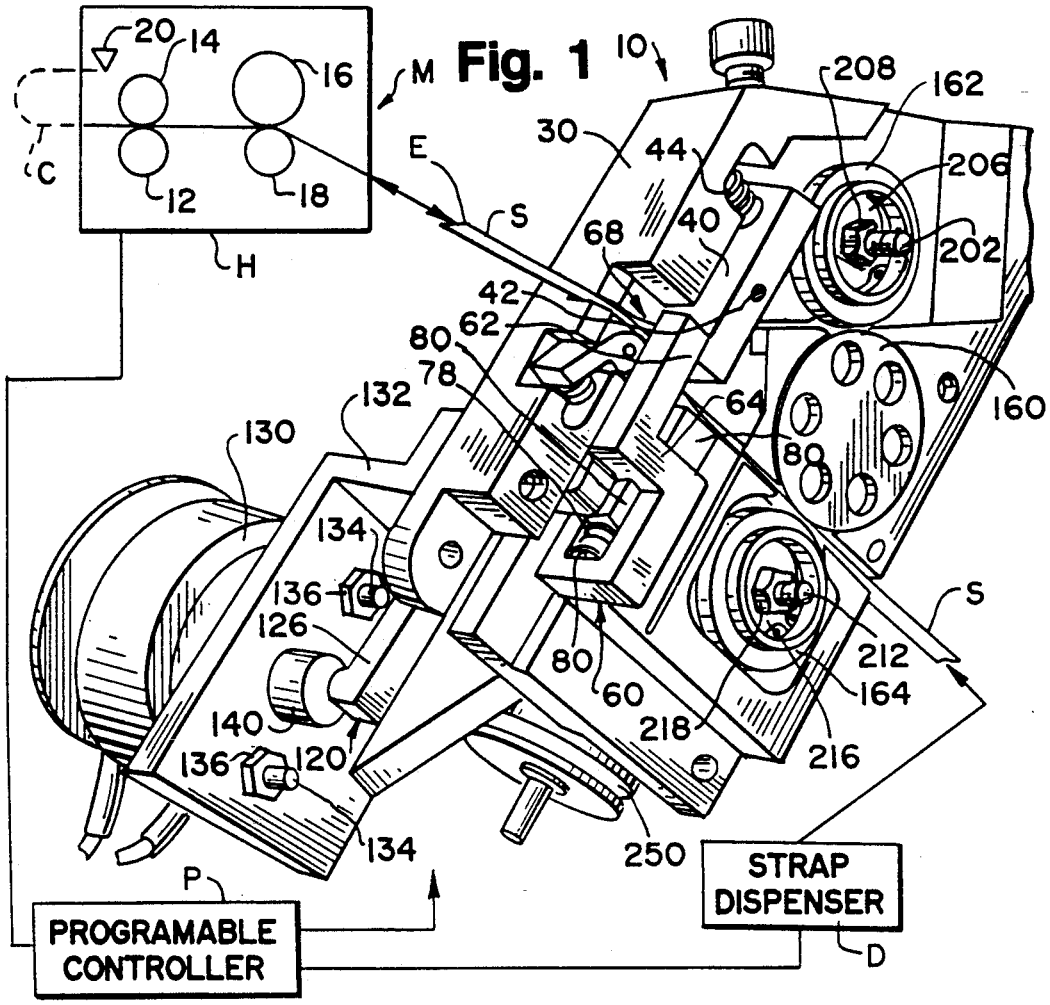
FIG. 1 is a perspective view of a mechanism according to this invention, as seen from the front, one side, and bottom thereof the mechanism, along with diagrammatic representations of a strap dispenser and certain elements of a strapping machine, particularly certain rollers of a strapping head and a sensor associated with the strapping head. A programmable controller for controlling the dispenser and the strapping machine is shown diagrammatically. A strap is shown fragmentarily.

As shown in the drawings, a mechanism 10 according to a preferred embodiment of this invention is utilized with a dispenser D for a strap S, with a strapping machine M including a strapping head H, and with a programmable controller P for controlling the dispenser D and the strapping machine M. The mechanism 10 automates certain-severing, ejecting, and feeding operations of the strapping machine. Except for certain elements shown diagrammatically and discussed herein, the strapping machine M is not shown.

The strap S may be an indeterminate length of any known type of plastic strapping, such as poly(ethylene terephthalate) or polypropylene strapping. The dispenser D may be any suitable dispenser known heretofore. Suitable strapping and suitable dispensers are available commercially from Signode Packaging systems (a division of Illinois Tool Works Inc.) of Glenview, Ill., under the SIGNODE trademark. Details of the strap S and details of the dispenser D are outside the scope of this invention.

The strapping head H comprises a pair of advancing rollers 12, 14, for advancing the strap S fed into the strapping head H around a load (not shown) being strapped, via a strap chute C of the strapping machine M. The strapping head H also comprises a pair of retracting rollers 16, 18, for retracting the strap S. The rollers are arranged in a known manner so that, when the rollers 12, 14, are driven for advancing the strap S, the rollers 16, 18, are separated to permit the strap S to pass freely therebetween and so that, when the rollers 16, 18, are driven for retracting the strap S, the rollers 12, 14, are separated to permit the strap S to pass freely therebetween. The rollers 12, 14, and the rollers 16, 18, are similar to rollers known heretofore in strapping machines of the type noted above.

The strapping head H further comprises a sensor 20 for sensing whether a leading end E of the strap S being advanced has reached a predetermined location relative to the strapping head H, within a predetermined time during an operating cycle of the strapping machine M. Except as described herein, the sensor 20 is similar to sensors known heretofore in strapping machines of the type noted above. In one known form (not shown) such a sensor comprises a lever arranged to be pivoted by a passing strap and a proximity sensor arranged to detect pivoting of the lever. Details of the sensor 20 are outside the scope of this invention.

Except as described herein, the strapping machine M is similar to strapping machines known heretofore, and the programmable controller P is similar to programmable controllers known heretofore for use with such machines. Suitable strapping machines equipped with suitable strapping heads and with suitable programmable controllers are available commercially from Signode Packaging Systems, surra, under the SIGNODE trademark. Except as illustrated in the drawings and described herein, details of the strapping head H, the programmable controller P, and other elements of the strapping machine M are outside the scope of this invention.

Figure 7:
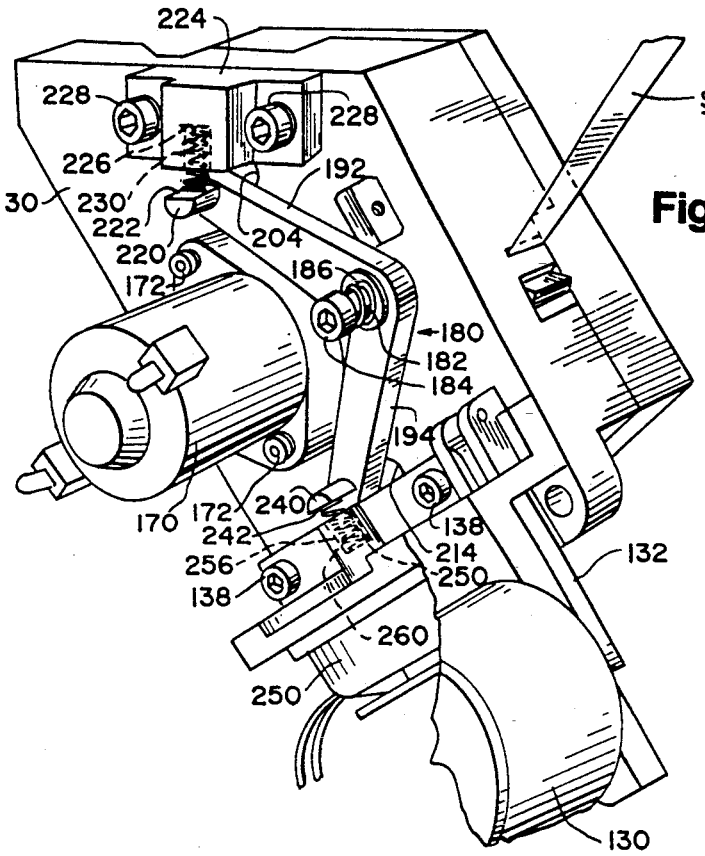
FIG. 7 is an enlarged, perspective view of the mechanism, as seen from the back, one side, and top.

As shown in FIG. 1 other views, the mechanism 10 is arranged so that a strap S being fed into the strapping head H from the dispenser D passes through the mechanism 10. The mechanism 10 comprises a housing structure 30, which is mounted fixedly to the strapping machine M, and a front cover 32, which is shown in FIG. 7 but which is omitted in FIG. 1 to reveal details that would be otherwise concealed. The front cover 32 is secured by machine screws (not shown) to the housing structure 30.

Various elements are mounted operatively to the housing structure 30. These elements include means for severing the strap S being fed into the strapping head H into a leading portion L including the leading end and a trailing portion T if the sensor 20 has not sensed that the leading end E has reached the predetermined location relative to the strapping head H, within the predetermined time during an operating cycle of the strapping machine M, and means adapted to coact with the retracting rollers 16, 18, for ejecting the leading portion L after the strap S has been severed.

An anvil 40 is mounted pivotally, via a pivot pin 42 extending from the housing structure 30, so as to permit pivotal movement of the anvil 40 over a small range. The anvil 40 is biased in one rotational direction, which is clockwise in FIG. 1, via a coiled spring 44 bearing on the housing structure 30 and on the anvil 40. As shown in FIGS. 2, 3, 4, and 5, the anvil 40 has a slot 48 having inclined surfaces for a purpose to be later described, and a cutting edge 50, which may be suitably hardened.

A die 60 having a stepped configuration defining a leading portion 62, a middle portion 64, and a trailing portion 66 is mounted slidably to the housing structure 30 so as to permit the die 60 to slide along the anvil 40 in a forward direction (which is indicated by an arrow in FIG. 6) and in a reverse direction. The die 60 is biased in the rearward direction, toward a retracted position, in a manner to be later described.

The leading portion 62 has a slot 68 having inclined surfaces (see FIGS. 2, 3, 4, and 5) and defining a cutting edge 70. The cutting edge 70 coacts with the cutting edge 50 of the anvil 40 to sever a strap S when the die 60 is moved slidably from its retracted position, in the forward direction, in a manner to be later described.

The die 60 is biased in its reverse direction, toward its retracted position, directly by a spring 72, which is seated in a socket 74 in the middle portion 64 of the die 60, and indirectly in a manner to be later described. The spring 72 bears against a boss 76 extending from the housing structure 30.

A gripper 80 is mounted in an elongate slot 82 in the trailing portion 66 of the die 60. The elongate slot 82 opens in the forward direction. The gripper 80 has a flange 84 extending through the slot 82. The flange 84 is adapted to engage the central portion 64 of the die 60 so as to limit forward movement of the gripper 80 relative to the die 60. A coiled spring 86, which is seated in a socket formed in the gripper 80 and in a socket formed in the trailing portion 66 of the die 60, biases the gripper 80 in the forward direction. The gripper 80 coacts with an adjacent surface 88 of the housing structure 30, in a manner to be later described, to grip the leading end E' of the trailing portion T of a strap S being severed.

A small lever 90 mounted pivotally to the housing structure 30, via a pivot pin 92, has a lever arm 94 extending into the inclined slot 68 of the leading portion 62 of the die 60 and a lever arm 96 defining an obtuse angle relative to the lever arm 94. The lever 90 is biased toward a normal position, in which the lever arm 96 engages a corner 98 formed on the housing structure 30, via a coiled spring 100. The spring 100 is seated in a socket 102 formed in the housing structure 30 and bears against the second arm 96. Indirectly, the spring 100 also biases the die 60 in the reverse direction, through contact of the lever arm 94 with one edge of the inclined slot 68 of the leading portion 68 of the die 60.

Figure 2:
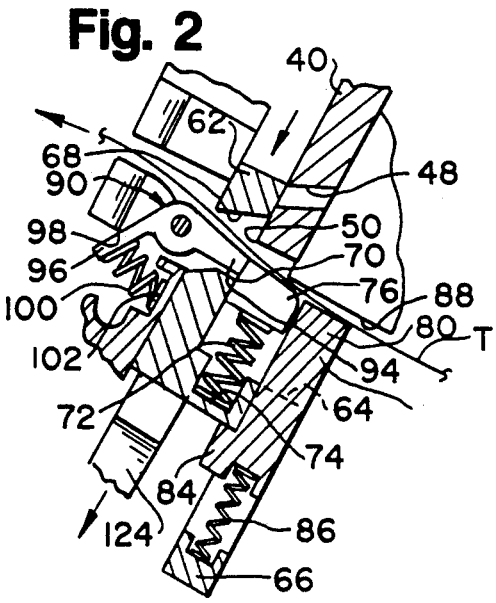
FIGS. 2, 3, 4, and 5 are cross-sectional details showing an anvil, a die, and certain related elements of the mechanism at successive stages in its operation.
Figure 3:
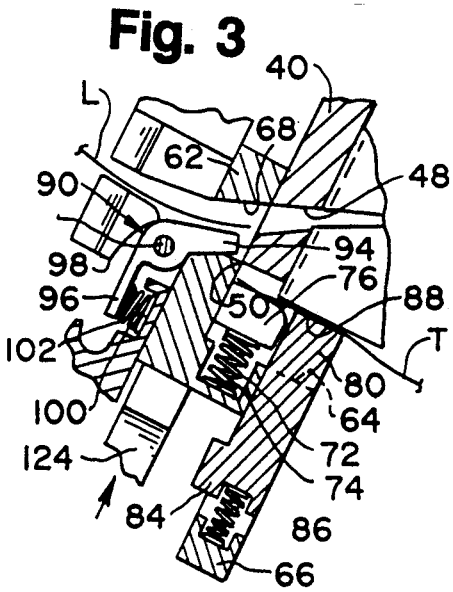
Figure 4:
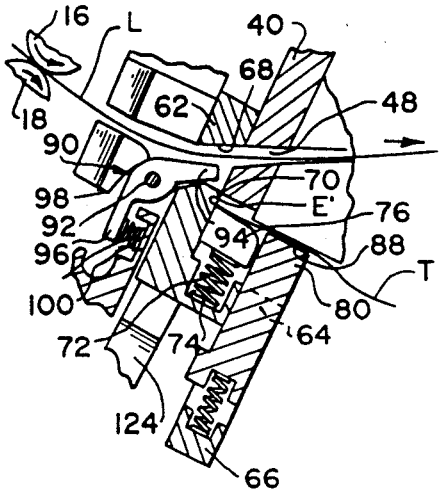
Figure 5:
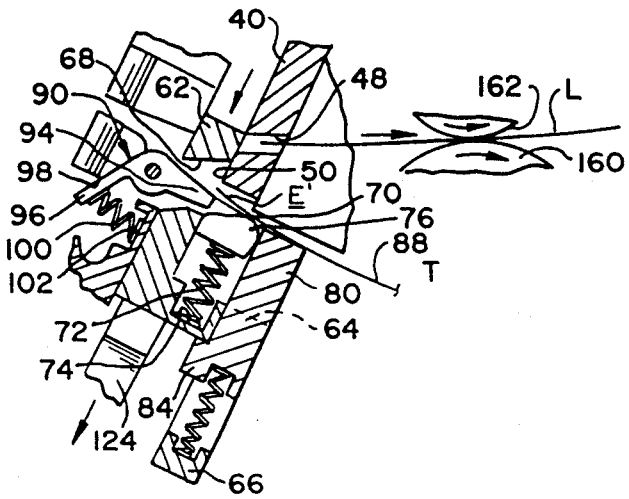

The lever 90 is shown in its normal position in FIGS. 2 and 5 and in a displaced position in FIGS. 3 and 4. The lever 90 is arranged so that it is pivoted from its normal position, into its displaced position, when the die 60 is moved slidably in the forward direction.

A large lever 120 mounted pivotally to the mounting bracket 32, via a pivot pin 122, has a lever arm 124 bearing against the middle portion 64 of the die 60 at a rounded portion of the lever arm 124 and a lever arm 126 defining approximately a right angle relative to the lever arm 124.

A solenoid 130 of a conventional "push" type is mounted operatively to a mounting bracket 132 by threaded studs 134 on the solenoid 130 receiving threaded nuts 136. The mounting bracket 132 is secured to the housing structure 30 by capscrews 138. The solenoid 130 has internal parts (not shown) including a coil and a core coacting with the coil. A plunger 140 is fixed to the core with setscrews (not shown) such that the plunger 140 moves conjointly with the core. The lever arm 126 has a rounded portion bearing against the plunger 140.

Figure 6:
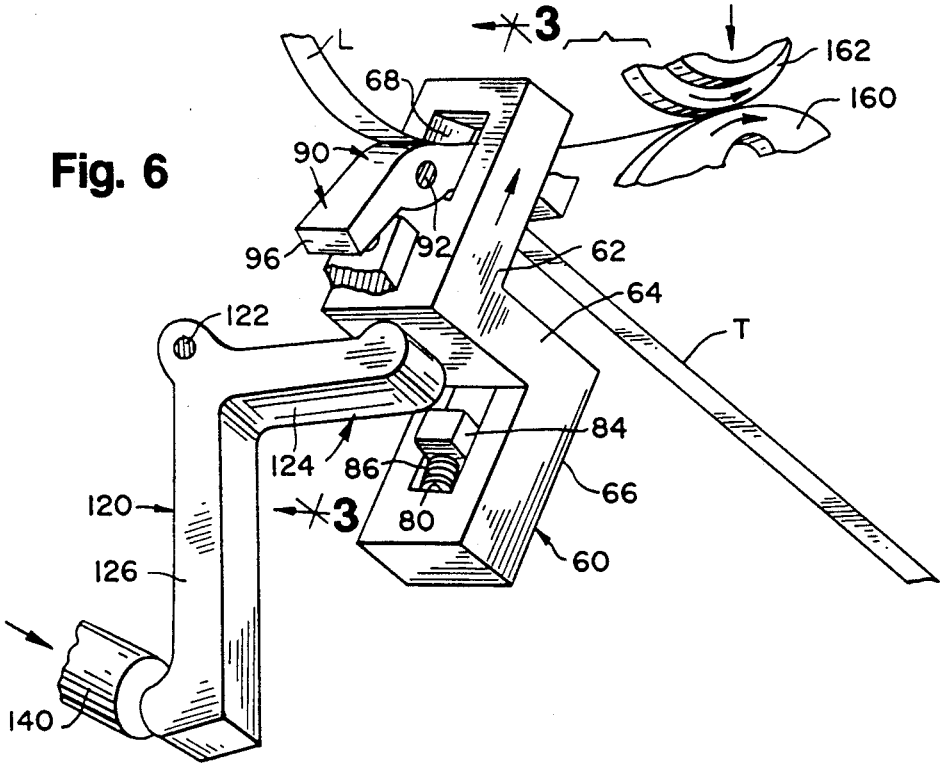
FIG. 6, on a larger scale, is a fragmentary, perspective detail of the anvil, the die, and certain related elements of the mechanism at the stage shown in FIG. 4.

The solenoid 130 is arranged so that the plunger 140 is extended from the withdrawn position, in a direction indicated by an arrow in FIG. 6, when the solenoid 130 is energized and so that the plunger 140 is returned to its withdrawn position, by the springs 72, 100, which bias the die 60 in the reverse direction, and by the lever 120, which bears against both the middle portion 64 of the die 60 and the plunger 140.

When the solenoid 130 is energized, the plunger 140 pivots the large lever 120 so that the lever arm 124 moves the die 60 slidably in its forward direction, along the anvil 40, and so as to pivot the small lever 90 from its normal position, into its displaced position. As a result, a strap S being fed through the mechanism 10 is severed by the cutting edges 50, 70, into a leading portion L and a trailing portion T, which has a leading end E' where the strap S has been severed.

Figure 8:
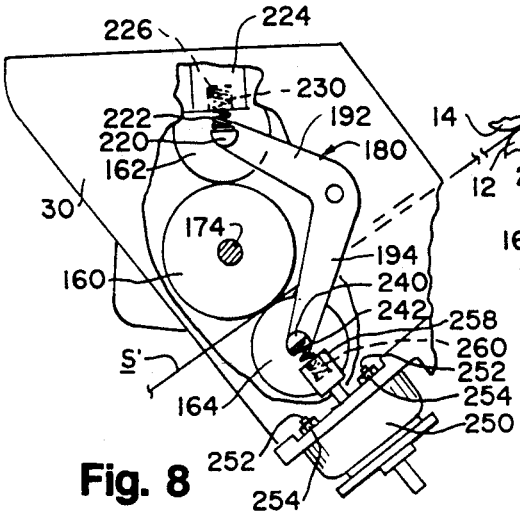
FIGS. 8, 9, and 10 are fragmentary details showing certain rollers, a pivotable yoke, and a solenoid of the mechanism at successive stages in its operation.

Three rollers are mounted operatively, namely a drivable roller 160, an idle roller 162, and an idle roller 164. The drivable roller 160 is arranged to be rotatably driven by a motor 170 of a conventional type. The motor 170, which is secured to the housing structure 30 by machine screws 172, has a shaft 174 (see FIG. 8) extending through an aperture (not shown) in the housing structure 30 and mounting the drivable roller 160 for conjoint rotation with the shaft 174 when the motor 170 is actuated. The motor shaft 174 and the drivable roller 160 are arranged to rotate freely when the motor 170 is not actuated.

The idle rollers 162, 164, are mounted operatively to a yoke 180, which is mounted pivotally and slidably on a shaft 182 having an enlarged head 184 and extending from the housing structure 30. The yoke 180 is biased along the shaft 182, toward the housing structure 30, by a coiled spring 186 disposed between the shaft head 184 and the yoke 180. The yoke 180 has two yoke arms 192, 194, which define an obtuse angle relative to each other.

The yoke arm 192 carries a shaft 202 (FIG. 1) which has a threaded end and which extends through an aperture 204 (FIG. 7) in the housing structure 30. The idle roller 162 is mounted rotatably on the shaft 202, via a bearing 206 secured on the shaft 202 by a threaded nut 208. The aperture 204 is larger than the shaft 202. The yoke arm 194 carries a threaded shaft 212 (FIG. 1) which has a threaded end and which extends through an aperture 214 (FIG. 7) in the housing structure 30. The idle roller 162 is mounted rotatably on the shaft 212, via a bearing 216 secured on the shaft 212 by a threaded nut 218. The aperture 214 is larger than the shaft 212. Because each aperture is larger than the shaft extending therethrough, the yoke 180 is pivotable over a limited range of pivotal movement. The yoke 180 is biased to a normal position, which is one end of such range, in a manner to be next described. The yoke 180 is pivotable to a displaced position.

The yoke arm 192 has an integral boss 220 having a flat surface 222. A bracket 224 having a socket 226 is secured to the housing structure 30, near the boss 220, via machine screws 228. A coiled spring 230 seated in the socket 226 bears against the flat surface 222 of the boss 220 so as to bias the yoke 180 in one pivotal direction, which is counterclockwise in FIG. 6. The yoke arm 194 has an integral boss 240 having a flat surface 242.

A solenoid 250 of a conventional "push" type is secured to the mounting bracket 132, near the boss 240, via threaded studs 252 on the solenoid 250 receiving threaded nuts 254. The solenoid 250 has internal parts including a coil (not shown) and a core 256 (FIG. 10) coacting with the coil. A plunger 258 having a socket is fixed to the core 256 by setscrews (not shown). A coiled spring 260 seated in the socket in the plunger 258 bears against the boss 240.

Figure 9:
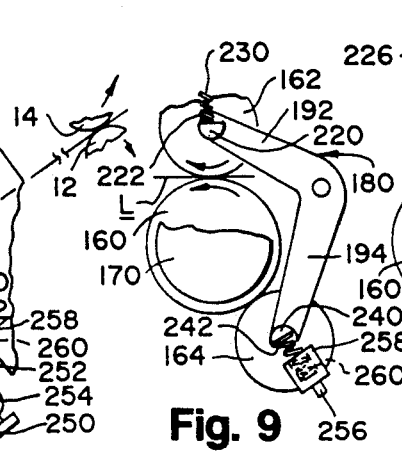

When the solenoid 250 is deenergized, the plunger 258 is biased to the retracted position, which corresponds to the normal position of the yoke 180. In the normal position, the yoke 180 is disposed so that the idle roller 162 is disposed in rolling engagement with the drivable roller 160 if no strap is disposed between the idle roller 162 and the drivable roller 160, and so that the idle roller 164 is spaced from the drivable roller 160 sufficiently to permit a strap S to pass freely between the idle roller 164 and the drivable roller 160. As suggested in FIGS. 6 and 9, if a strap is disposed between the idle roller 162 and the drivable roller 160, the strap is driven so as to eject the strap from the mechanism 10 when the drivable roller 160 is driven.

Figure 10:
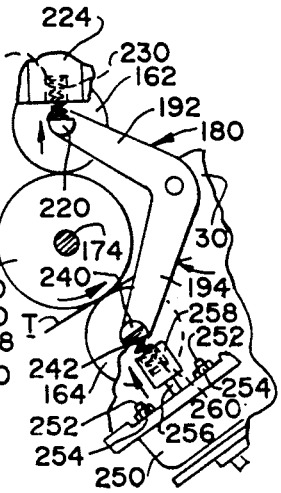

When the solenoid 250 is energized, the plunger 258 is advanced from the retracted position, in a direction indicated by an arrow in FIG. 10, so that the yoke 180 is pivoted from its normal position, into its displaced position. Thus, the idle roller 164 is disposed in rolling relationship with the drivable roller 160 if no strap is disposed between the idle roller 164 and the drivable roller 160. Also, the idle roller 162 is spaced from the drivable roller 160. As suggested in FIG. 10, if a strap is disposed between the idle roller 164 and the drivable roller 160, the strap is driven from the strap dispenser D, through the mechanism 10, into the strapping machine M when the drivable roller 160 is driven.

During an operating cycle of the strapping machine M, a strap S from the dispenser D is threaded through the mechanism 10, into the strapping head H. As the solenoid 250 is deenergized, the strap S passes freely between the drivable roller 160 and the idle roller 164. As the solenoid 130 is deenergized, the strap S passes freely between the anvil 40 and the boss 76, and along the lever arm 94 of the small lever 90.

In normal operation, the strapping head H is operated so that the strap S passes freely between the retracting rollers 16, 18, and is advanced by the advancing rollers 12, 14, along the strap chute C, around the load, until the leading end E of the strap S returns to the strapping head H. If the sensor 20 senses that the leading end E has reached a predetermined location relative to the strapping head H, within a predetermined time during the operating cycle, normal operation is continued. As normal operation is continued, the strap S is secured in a tensioned loop around the load either by welding the strap S to itself at its overlapping portions or by applying a metal seal to the overlapping portions, and the strap in the tensioned loop is severed from the remaining strap.

However, the mechanism 10 is operated if the sensor 20 does not sense that the leading end E has reached the predetermined location within the predetermined time, as when the strap S has become jammed within the strap chute C or has exited from the strap chute C before reaching the sensor 20. Thus, the solenoid 130 is actuated to sever the strap between the cutting edge 70 of the die 60 and the cutting edge 50 of the anvil 40, whereby the strap S is severed into a leading portion L including the leading end E and a trailing portion T having a leading end E' where the strap S has been severed. The leading end E' is blocked by the leading portion 62 of the die 60 and is gripped between the gripper 80 and the adjacent surface 88 of the housing structure 30.

When the solenoid 130 is energized, the small lever 90 is pivoted from its normal position, into its displaced position. Moreover, the advancing rollers 12, 14, are released from the leading portion L and the retracting rollers 16, 18, are driven to retract the leading portion L. As retracted, the leading portion L is diverted by the lever arm 94 of the small lever 90 in its displaced position, through the slot 48 of the anvil 40. Thus, the leading portion L is guided by the inclined surfaces of the slot 48 so that the leading portion L is engaged by the rollers 160, 162, which then function as ejecting rollers. Furthermore, the motor 170 is energized to drive the roller 160, whereby the rollers 160, 162, eject the leading portion L to a suitable receptacle (not shown) for discarding or recycling.

After a timed interval sufficient for the rollers 160, 162, to eject the leading portion L, the solenoid 130 is deenergized, and the solenoid 250 is energized. The motor 170 remains energized to drive the roller 160, whereby the rollers 160, 164, function as feeding rollers and feed the strap S beginning with the trailing portion T through the mechanism 10, into the strapping head H. After the timed interval noted above, the rollers 16, 18, are separated to permit the strap S to pass freely therebetween, and the rollers 12, 14, are arranged to advance the strap S when the leading end E' of the trailing portion T is fed between the rollers 12, 14. After a timed interval sufficient for the leading end E' to be thus fed therebetween, the motor 170 and the solenoid 250 are deenergized, whereupon normal operation may be then resumed.

Various modifications may be made in the preferred embodiment described above without departing from the scope and spirit of this invention.

I claim:

1. For use with a strapping machine of a type having a strapping head, which includes means for advancing a strap fed into the strapping head, means for sensing whether a leading end of the strap being advanced by the advancing means has reached a predetermined location within a predetermined time, and means for retracting the strap, a mechanism comprising means coacting with the sensing means for severing the strap being fed into the strapping head into a leading portion including the leading end and a trailing portion if the sensing means has not sensed that the leading end has reached the predetermined location within the predetermined time and means coacting with the retracting means for ejecting the leading portion after the strap has been severed.

2. The mechanism of claim 1 further comprising means for feeding the trailing portion to the advancing means after the leading portion has been ejected.

3. The mechanism of claim 2 wherein the ejecting means and the feeding means comprise a common, drivable roller, wherein the ejecting means comprises a separate, idle roller movable toward and away from the drivable roller, and wherein the feeding means comprises a separate, idle roller movable toward and away from the drivable roller.

4. The mechanism of claim 3 further comprising means for moving the idle roller of the ejecting means toward the drivable roller when the leading portion is to be thus ejected and for moving the idle roller of the feeding means toward the drivable roller when the trailing portion is to be thus advanced.

5. The mechanism of claim 4 further comprising a motor arranged to drive the drivable roller when the leading portion is to be thus ejected and when the trailing portion is to be thus advanced.

6. The mechanism of claim 4 wherein the moving means comprises a pivotable yoke, to which the idle rollers are mounted rotatably and in spaced relation, and a solenoid arranged to pivot the pivotable yoke.

7. The mechanism of claim 6 wherein the solenoid is arranged to pivot the pivotable yoke from a normal position selectively to a position wherein the idle roller of the ejecting means is moved toward the drivable roller and a position wherein the idle roller of the feeding means is moved toward the drivable roller.

8. The mechanism of claim 7 wherein the pivotable yoke is biased toward the normal position.

* * * * *